United States Patent [19]

Ogino

[11] Patent Number: 4,870,409

[45] Date of Patent: Sep. 26, 1989

[54] AUTOMATIC DOOR LOCK CONTROL DEVICE ON VEHICLE

[75] Inventor: Seiichi Ogino, Kiryu, Japan

[73] Assignee: Mitsuba Electric Manufacturing Co., Ltd., Gunma, Japan

[21] Appl. No.: 130,167

[22] Filed: Dec. 8, 1987

[30] Foreign Application Priority Data

Dec. 9, 1986 [JP] Japan ..... 61-292958

[51] Int. Cl.[4] ..... F05B 63/00

[52] U.S. Cl. ..... 340/825.18; 292/201; 361/172; 70/264

[58] Field of Search ..... 340/825.18; 180/286, 180/289; 70/256, 257, 238, 239, 277, 264; 292/DIG. 3, 201; 361/172, 193

[56] References Cited

U.S. PATENT DOCUMENTS 4,483,410 11/1984 Fey .

4,502,718 3/1985 Sasaki et al. ..... 292/201

FOREIGN PATENT DOCUMENTS 2735999 2/1979 Fed. Rep. of Germany ..... 292/201

*Primary Examiner*—Gerald L. Brigance

*Attorney, Agent, or Firm*—Oliff & Berridge

[57] ABSTRACT

There is provided an automatic door lock control device on a vehicle which includes a first switch operable by a driver, a second switch operable by an occupant other than the driver, and an automatic control device. The automatic control device issues a control command for simultaneous operation of the door lock operation mechanisms associated with the driver and the other occupant upon receipt of a signal from the first switch, and issues a control command for operation of the door lock operation mechanism associated with the other occupant upon receipt of a signal from the second switch. The automatic control device is provided with a predominance determination unit which gives priority to the signal from the first switch over the signal from the second switch to avoid conflicting commands to the door lock operation mechanisms.

2 Claims, 4 Drawing Sheets

AUTOMATIC DOOR LOCK CONTROL DEVICE ON VEHICLE

BACKGROUND OF THE INVENTION

This invention relates to an automatic door lock control device on a vehicle such as a passenger car or the like.

On some of the vehicles of the above type generally, door locks have been automatically locked and unlocked by door lock operation mechanisms comprising actuators such as motors or solenoids provided on the redspective doors of the vehicles. The actuators on the vehicular doors have been simultaneously operated as a group by the dominative switch accessible by the driver, but the door locks assigned to the occupants other than the driver still have to be manually manipulated at the locations of the other occupants. Thus, the door lock manipulation is troublesome and complicated.

It has been proposed to provide switches accessible by the other occupants so that door locks also can be controlled by the switches accessible by the other occupants from their locations. In such a case, the driver is required to dominate the operation of the actuators on all the vehicular door locks from the viewpoint of safety. As a result, when the driver and other occupants simultaneously manipulate the switches accessible by them, the switches simultaneously issue commands the actuator assigned to the driver. If the commands coincide with each other, there is no difficulty. However, the commands from the switches accessible by the driver and other occupants may conflict with each other, and the conflicting commands are undesirable in the automatic control of door locks through the use of actuators. This problem has to be solved.

SUMMARY OF THE INVENTION

With the above-mentioned problem in mind, the present invention has as its object to provide an automatic door lock control device on a vehicle which eliminates the drawbacks inherent in the prior door lock operation mechanisms referred to hereinabove. The inventive automatic door lock control device comprises switch means accessible by a driver, switch means accessible by an occupant other than the driver and automatic control means adapted to issue a control command for simultaneous operation of door lock operation mechanisms assigned to the driver and other occupant upon receipt of a signal from the switch means accessible by the driver and to issue a control command for operation of the door lock operation mechanism assigned to the other occupant upon receipt of a signal from the other occupant's switch means, the automatic control means being provided with predominance determination means which gives priority to the signal from the switch means accessible by the driver over the signal from the switch means accessible by the other occupant.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the same thereto in any way.

BRIEF DESCRIPTION OF THE DRAWINGS

The accompanying drawings show preferred embodiments of the automatic door lock control device on a vehicle constructed in accordance with the principle of the present invention wherein.

PREFERRED EMBODIMENTS OF THE INVENTION

The present invention will now be described referring to the accompanying drawings, and more particularly to FIG. 1 thereof in which a circuit diagram for the first embodiment of the invention is illustrated. Description will be had for the instance wherein the automotive automatic door lock control device of the invention is applied to a two-door type vehicle having driving compartment doors accessible by the driver and front passenger, respectively, the automatic door lock control device being adapted to lock and unlock the door locks on the doors employing actuators as the operation mechanisms.

Figure 1:
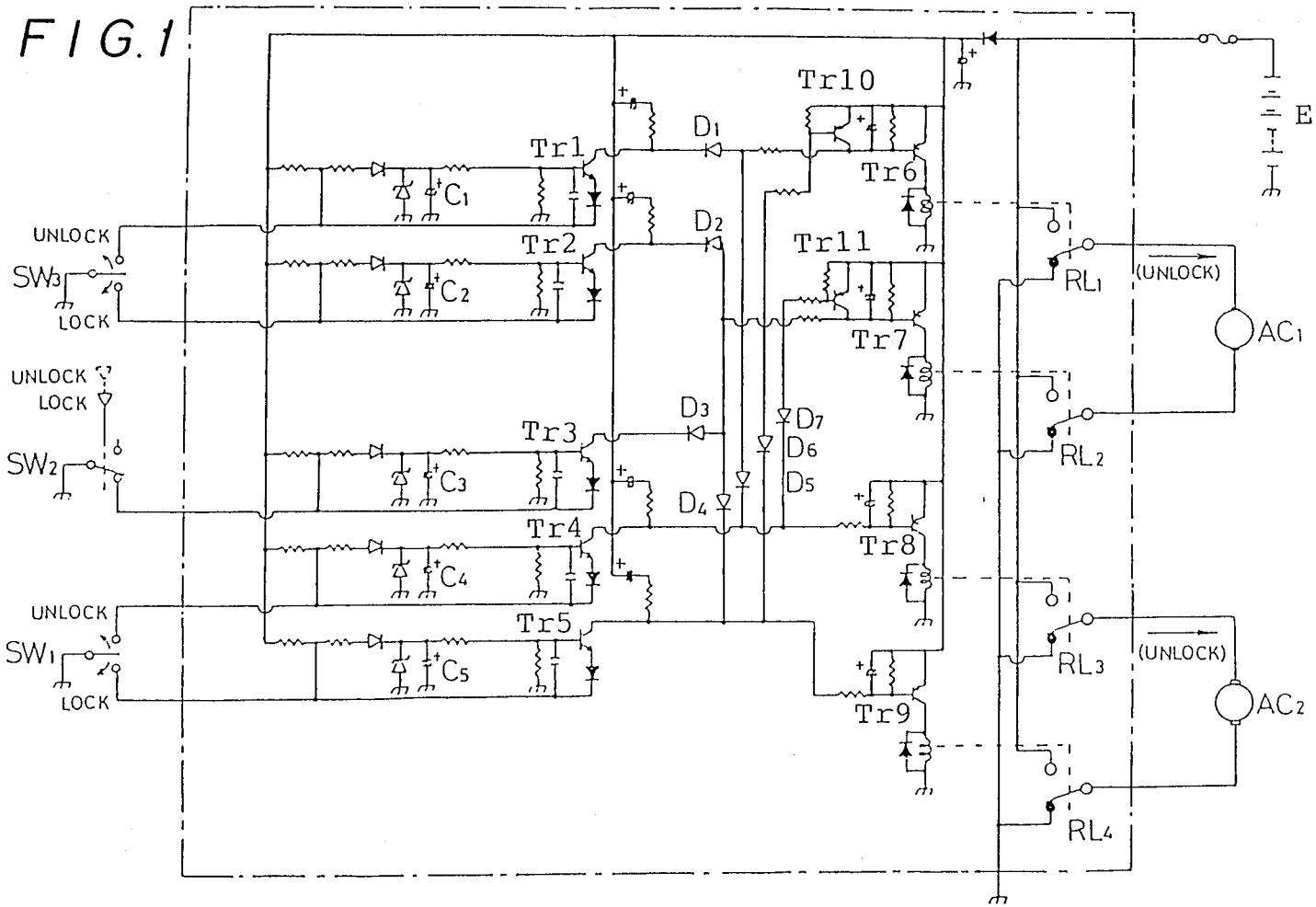
FIG. 1 is a circuit diagram for the first embodiment.

In FIG. 1, SW1 denotes a switch accessible by the driver, SW2 denotes a switch adapted to turn on when the knob (not shown) for the door lock accessible by the driver is manually manipulated for door locking, and SW3 denotes a switch accessible by the front passenger. These switches are provided in suitable locations in the driving compartment. The contacts of the switches SW1–SW3 are connected to the emitter terminals of the respectively associated transistors Tr1–Tr5. Connected to the base terminals of the transistors Tr1–Tr5 are capacitors C1–C5 which are designed to become predetermined optional time constants with respect to discharge time. The collector terminals of the transistors are connected to the positive terminal of a power source E. When the switch SW1 accessible by the driver is manipulated for door locking, for example, the emitter terminal of the transistor Tr5 is grounded whereby the transistor is in ON condition for only the discharge time determined by the time constant of the capacitor C5. While the transistor Tr5 is in ON conditioon, an ON command from the capacitor C5 is transmitted to a transistor Tr9 and through a diode D4 to a transistor Tr7 to turn the two transistors ON to thereby operate relay switches RL4, RL2 connected to the transistors Tr9 and Tr7, respectively, which in turn simultaneously operate actuators AC2, AC1 assigned to the driver and front passenger, respectively, for door locking. In this way, the door locks for the driver and front passenger can be automatically and simultaneously locked.

On the other hand, when the switch SW1 accessible by the driver is manipulated for door unlocking, then the transistor Tr4 is in ON condition while the capacitor C4 is discharging. In connection with the ON condition of the transistor Tr4, transistors Tr8, Tr6 turn ON to operate relay switches RL3, RL1 to thereby operate the actuators AC2, AC1 for door unlocking, whereupon the door locks assigned to the driver and front passenger, respectively, are simultaneously and automatically released from the locked condition. When the driver manually manipulates the lock knob under his control for door locking, the silicone switch SW2 turns on and the transistor Tr3 is in ON condition while the capacitor C3 is discharging to thereby operate the relay switch RL2 assigned to the front passenger for automatically locking the door lock for the front passenger. Furthermore, when the switch SW3 accessible by the front passenger is manipulated for door locking, the relay switch RL2 operates while the capacitor C2 is discharging, and when the switch SW3 is manipulated for door unlocking the relay switch RL1 operates while the capacitor C1 is discharging, whereby the actuator AC1 assigned to the front passenger can automatically perform door locking and unlocking. In this manner, automatic control means connected to each switch means is provided.

Furthermore, in this automatic control means, the collector terminal of the transistor Tr5 is connected to the base terminal of a transistor Tr10 through a diode D6. The emitter terminal of the transistor Tr10 is connected to the power source E in parallel to the emitter terminal of the transistor Tr6, and the collector terminal of the transistor Tr10 is connected to the base terminal of the transistor Tr6. When the switch SW1 accessible by the driver and the switch SW3 accessible by the front passenger are manipulated in a mutually conflicting way, that is the former is manipulated for door locking and the latter is manipulated for door unlocking, although the transistors Tr1, Tr5 turn ON, the transistor Tr10 turns ON through the diode D6 whereby the transistor Tr6 remains in OFF condition. At this time, the relay switch RL1 does not operate, but, as mentioned hereinabove, in response to the turning ON of the transistor Tr5, the relay switches RL2, RL4 opeate to thereby operate the actuators AC1, AC2 for door locking. And also in connection with the unlocking circuit of the switch SW1 accessible by the driver and the locking circuit of the switch SW3 accessible by the front passenger, a transistor Tr11 is provided such that a command from the switch SW1 accessible by the driver operates the actuators AC1, AC2 dominating a command from the switch SW3 accessible by the front passenger. Thus, a predominance determination unit is provided in the automatic control means.

In the embodiment having the components arranged as mentioned hereinabove, as described above, by the manipulation of the switch SW1 accessible by the driver and the switch SW3 accessible by the front passenger, automatic locking and unlocking can be performed. In addition, when the switch SW1 accessible by the driver is manipulated for door locking and unlocking, simultaneously the switch SW3 accessible by the front passenger is automatically operated for locking and unlocking. However, when the switch SW1 accessible by the driver and the switch SW3 accessible by the front passenger are simultaneously manipulated in mutually conflicting modes, by the operation of the transistor Tr10 or Tr11 provided between the circuits of the two switches a signal from the switch SW1 predominates a signal from the switch SW3 in operating the two actuators. As a result, even when the switch SW1 accessible by the driver is manipulated, the actuator AC1 assigned to the front passenger can automatically operate for locking and unlocking, a signal in conflict with a signal from the switch SW1 will not be issued to the actuator AC1 assigned to the front passenger and thus there is no difficulty with respect to the mechanism of automatic control. Furthermore, since the predominating control comes from the driver, the changeover from door locking to unlocking and vice versa is generally controlled by the driver who has full power for safe driving which can be performed with quite high safety. This is also true in the instance in which immediately after the switch SW3 accessible by the front passenger has been manipulated in a mode, the switch SW1 accessible by the driver is manipulated in the mode conflicting with the manipulation mode of the switch SW3, and thus the control device of the present invention ensures high safety.

The application of the automotive automatic door lock control device of the present invention is not limited to the two-door vehicle as described hereinabove in connection with the first embodiment, but is also equally applicable to four-door and other various types of vehicles.

Figure 2:
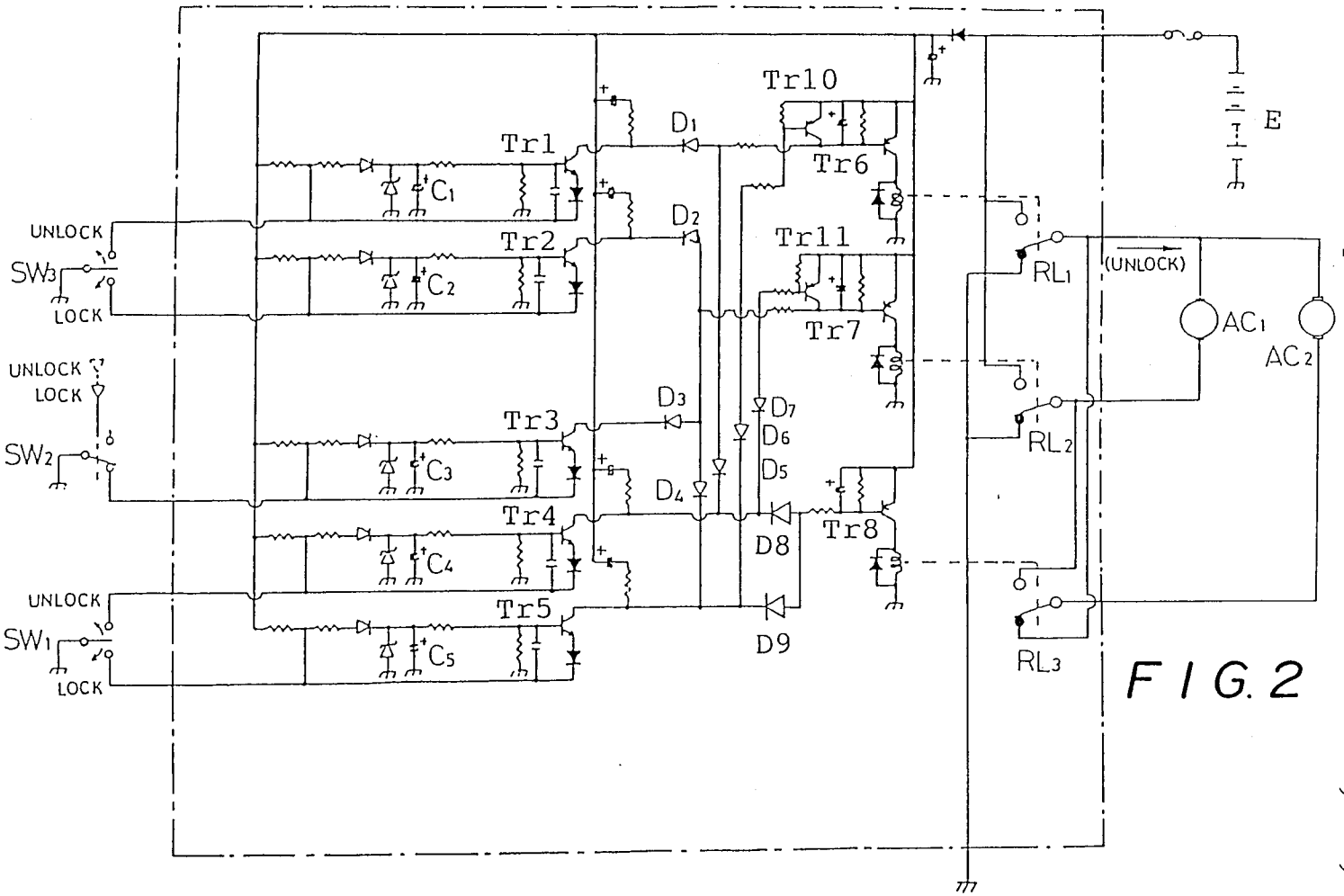
FIG. 2 is a circuit diagram for the second embodiment.

The circuit for the door lock control device of the invention is also not limited to the embodiment illustrated and described hereinabove. The present invention can be embodied as having three relay switches for changing over the actuators AC1, AC2 as shown in FIG. 2. That is, in the circuit diagram of FIG. 2, by manipulating the switches SW1, SW3 accessible by the driver and the front passenger, respectively, the actuator AC1 assigned to the front passenger and/or the acutator assigned to the driver are operated. Thus, when the transistors Tr4, Tr5, adapted to turn ON by the manipulation of the switch SW1 accessible by the driver for door locking and unlocking, are connected to the base terminal of the transistor Tr8 through diodes D8, D9, respectivley, and the switch SW1 is manipulated for door locking (unlocking), by the change over of the above-mentioned relay switch RL2 (relay switch RL1) and of the relay switch RL3, power from the power source such as a battery is conducted from the switch contact of the relay switch RL2 (relay switch RL1) to the actuator AC1 assigned to the front passenger and through the relay switch RL3 to the actuator AC2 assigned to the driver (power from the power source is conducted from the actuator AC2 assigned to the driver through the relay switch RL3) to simultaneously operate the actuators AC1, AC2 for door locking (unlocking). And when the switch SW3 accessible by the front passenger is manipulated, in the manner as described in connection with the first embodiment hereinabove, the actuator AC1 assigned to the assistant driver is operated for door locking/unlocking. With the arrangement of the components of the second embodiment, one relay switch means can be eliminated to thereby simplify the construction of the control device.

Figure 3:
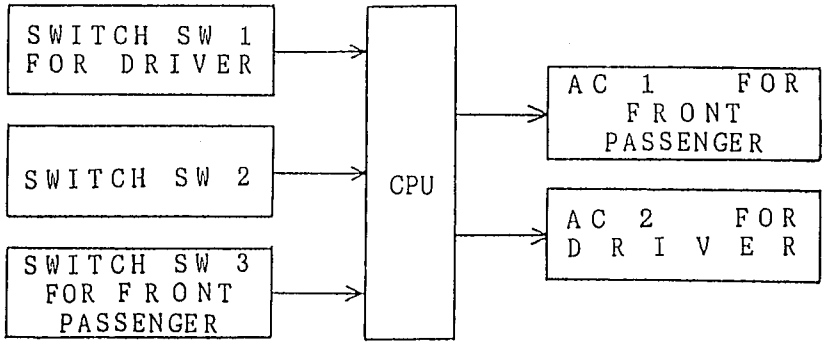
FIG. 3 is a block diagram of the third embodiment.
Figure 4:
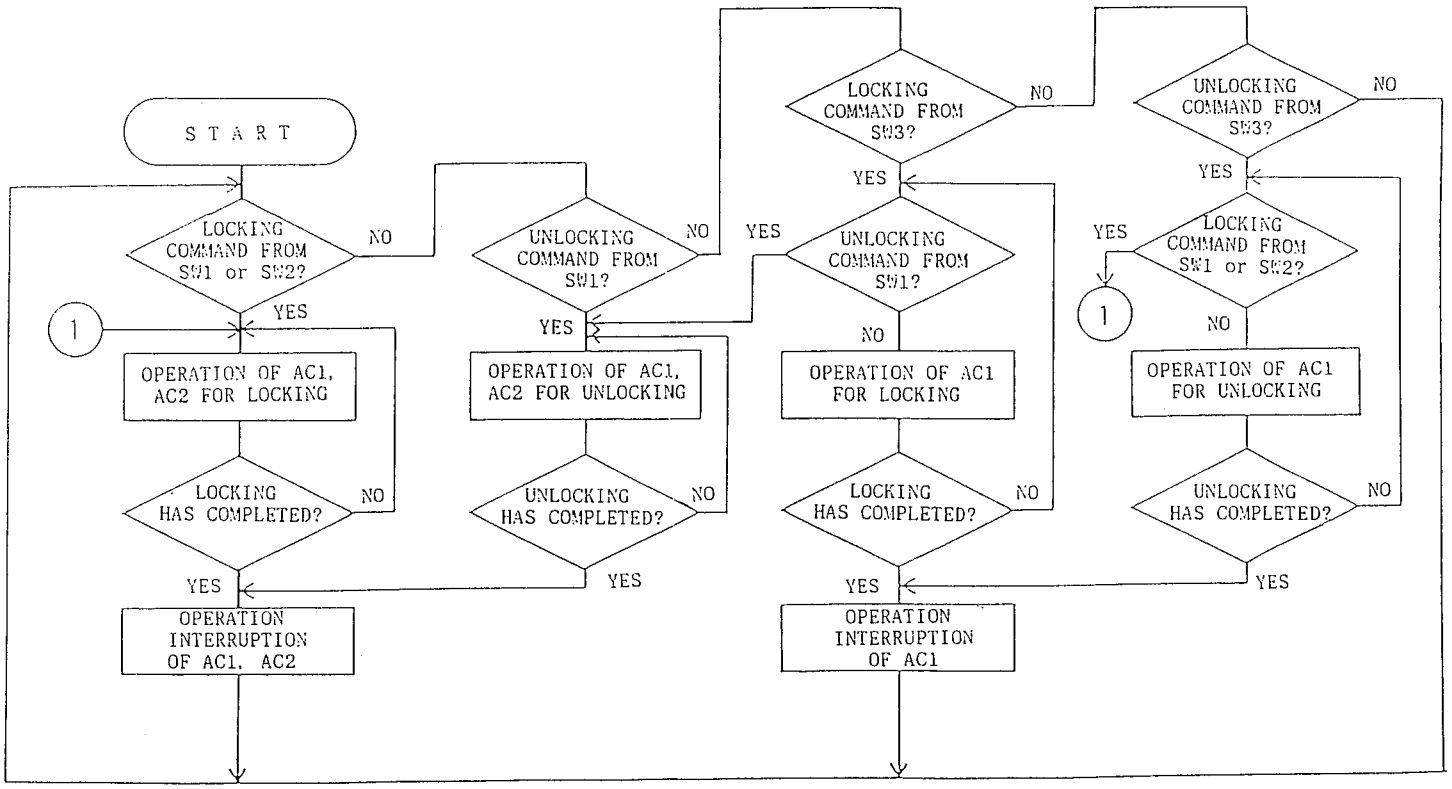
FIG. 4 is a flow chart of the third embodiment.

The present invention can be practiced by replacing the electrical circuit shown in FIG. 1 or FIG. 2 with an electronic means such as a computer or the like. This will be described in connection with the third embodiment which is shown by the block diagram and flow chart of FIGS. 3 and 4, respectively. The switches and actuators employed in the third embodiment are identical with the corresponding components of the first and second embodiments, respectively, but a microcomputer is employed as the automatic control means. First of all, it is determined whether or not a door locking signal has been issued from the switch SW1 accessible by the driver or the switch SW2, and, if so, the determination YES is made whereupon a door locking command is given to the two actuators AC1, AC2. After the door locking has been completed, a stop command is given to the actuators AC1, AC2. On the other hand, when no signal for door locking has been isued from the switch SW1 accessible by the driver or switch SW2 and the determination NO is made, then it is determined whether or not a door unlocking signal has been issued from the switch SW1 accessible by the driver. When such unlocking signal is present and the determination YES is made, an unlocking command is given to the actuators AC1, AC2. In this way, the door locks can be automatically controlled by the switch SW1 accessible by the driver.

As described hereinabove, in the automatic control means according to the present invention, first the presence or absence of a signal from the switch SW1 is preferentially determined, and when such signal is absent then the presence or absence of a signal from the switch SW3 accessible by the front passenger is determined and similarly the actuator AC1 is operated by a signal from the switch SW3 accessible by the front passenger to control door locking/unlocking. In this case, after the receipt of a signal from the switch SW3 accessible by the front driver and prior to the completion of operation of the actuator AC1, if the switch SW1 accessible by the driver or the switch SW2 issues a signal conflicting with the signal issuing from the switch SW3 accessible by the front passenger, the operation route is set so that after the determination as to whether or not the switch SW3 accessible by the front passenger has issued a signal or it is determined whether the switch SW1 accessible by the driver or switch SW2 has issued a signal conflicting with the signal from the switch SW3, and when the determination YES is made the operation of the actuator AC1 assigned to the front passenger is interrupted and the operation route is shifted to the operation route by the switch SW1 accessible by the driver or the switch SW2, whereby even when there is a time lag in operation between the switch SW1 accessible by the driver or the switch SW2 and the switch SW3 accessible by the front passenger a signal from the switch SW1 or the switch SW2 always predominates a signal from the switch SW3 to thereby ensure high safety in driving the vehicle.

In short, with the above-mentioned arrangement of the components of the automatic door lock control device according to the present invention, a signal from the switch means accessible by the driver can simultaneously operate the two door lock operation mechanisms assigned to the driver and front passenger, a commend from the front passenger's switch means can operate the door lock mechanism associated with the front passsenger's switch means. Thus, the door lock associated with the front passenger as well as that associated with the driver can be automatically controlled by the manipulation of the respectively pertinent switches to thereby substantially enhance operation efficiency. Furthermore, when the two switch means issue signals conflicting with each other, the predominance determination unit gives priority to the signal from the driver's switch means over the signal from the front passenger's switch means and the control is performed based on the priority principle. Thus, the disadvantage that mutually conflicting signals are issued from the two switch means can be perfectly eliminated. In addition, since the predominating signal is issued from the switch means accessible by the driver, the driver can positively exercise leadership in the operation of the door lock mechanisms, and thus the automatic door lock control device of the invention has quite high safety characteristics.

The drawings represent operative embodiments of the invention which are illustrative rather than restrictive, and various changes and modifications may be made within the scope of the appended claims. It is intended to cover such changes and modifications by suitable expression in the claims.

Various modes of carrying out the invention are contemplated as being within the scope of the following claims particularly pointing out and distinctly claiming the subject matter which is regarded as the invention.

What is claimed is:

1. An automatic door lock control device on a vehicle comprising:

first switch means operable by a driver for issuing a first signal;

second switch means operable by an occupant other than said driver for issuing a second signal; and automatic control means for issuing a control command for simultaneous operation of door lock operation mechanisms associated with said driver and said occupant upon receipt of said first signal from said first switch means, and for issuing a control command for operation of the door lock operation mechanism associated with said occupant upon receipt of said second signal from said second switch means, said automatic control means being provided with predominance determination means for giving priority to said first signal from said first switch means over said second signal from said second switch means.

2. The automatic door lock control device on a vehicle as set forth in claim 1, wherein said door lock operation mechanisms comprise actuators operable in response to said first and second signals from said first and second switch means.

* * * * *